US005671676A

United States Patent [19]

Baba et al.

[11] Patent Number: 5,671,676

[45] Date of Patent: Sep. 30, 1997

[54] FLEXOGRAPHIC PRINTER

[75] Inventors: Yasuyuki Baba; Arifumi Okamoto; Kunio Niuchi, all of Mihara, Japan

[73] Assignee: Mitsubishi Jukogyo Kabushiki Kaisha, Tokyo, Japan

[21] Appl. No.: 638,434

[22] Filed: Apr. 26, 1996

[30] Foreign Application Priority Data

Apr. 27, 1995 [JP] Japan ..... 7-104078

[51] Int. Cl.[6] ..... B41F 35/00

[52] U.S. Cl. ..... 101/425; 101/349

[58] Field of Search ..... 101/349, 366, 101/367, 348, 350, 423, 425, 147, 148

[56] References Cited

U.S. PATENT DOCUMENTS 5,259,553 11/1993 Shyu ..... 236/49.3

5,299,495 4/1994 Schoeps ..... 101/366

FOREIGN PATENT DOCUMENTS 4-128841 11/1992 Japan .

*Primary Examiner*—Ren Yan

*Attorney, Agent, or Firm*—Rothwell, Figg, Ernst & Kurz

[57] ABSTRACT

A flexographic printer in which ink supplied into a nip portion of inking rolls. The inking rolls include a rubber roll and an anilox roll. An inking roll cover is provided around the inking rolls. Clean air is directed into the inking roll cover through a filter, such as by a fan which blows air through an air vent into the inking roll cover so as to form a slightly higher static pressure within the inking roll cover than in the peripheral area. As a result, air is ejected to the outside of the inking roll cover from a gap between the inking roll cover and the printing cylinder. A dynamic pressure caused by the air prevents paper dust, paper scraps or other scattering dust, etc., from coming within the inking roll cover, thereby preventing such from sticking on the outer circumferential face of the rubber roll or the anilox roll, or from mixing with the ink supplied into the nip portion of the rubber roll and the anilox roll.

9 Claims, 3 Drawing Sheets

Fig. 2
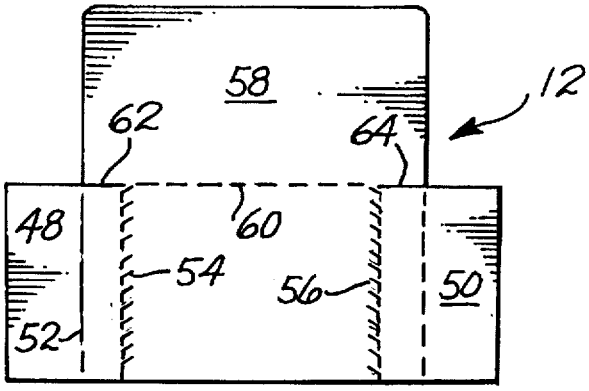
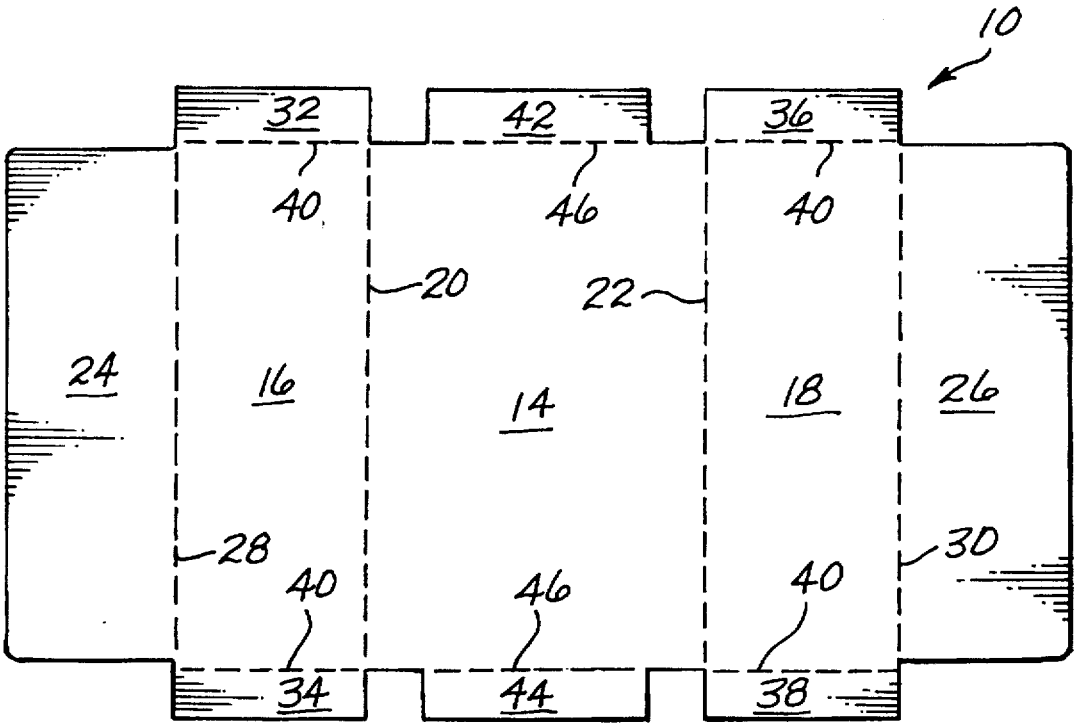
Fig. 1
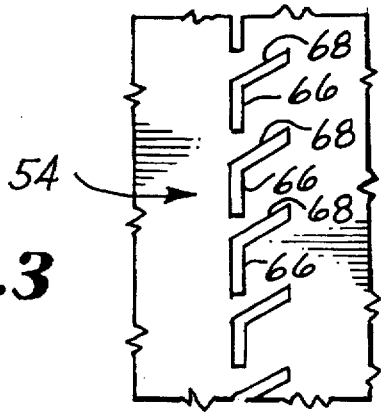
Fig. 3

Fig. 4
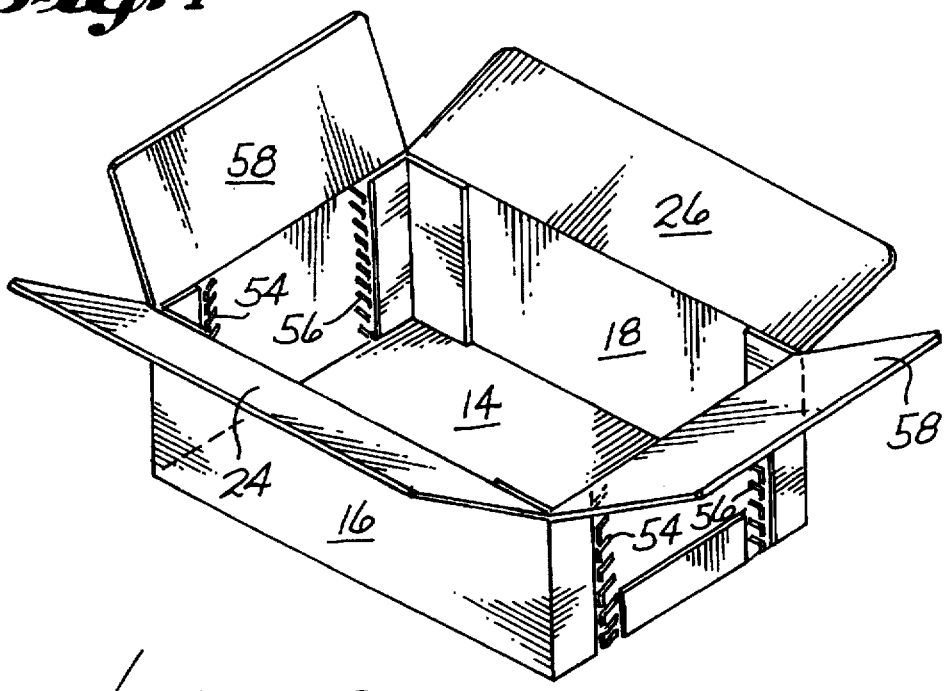
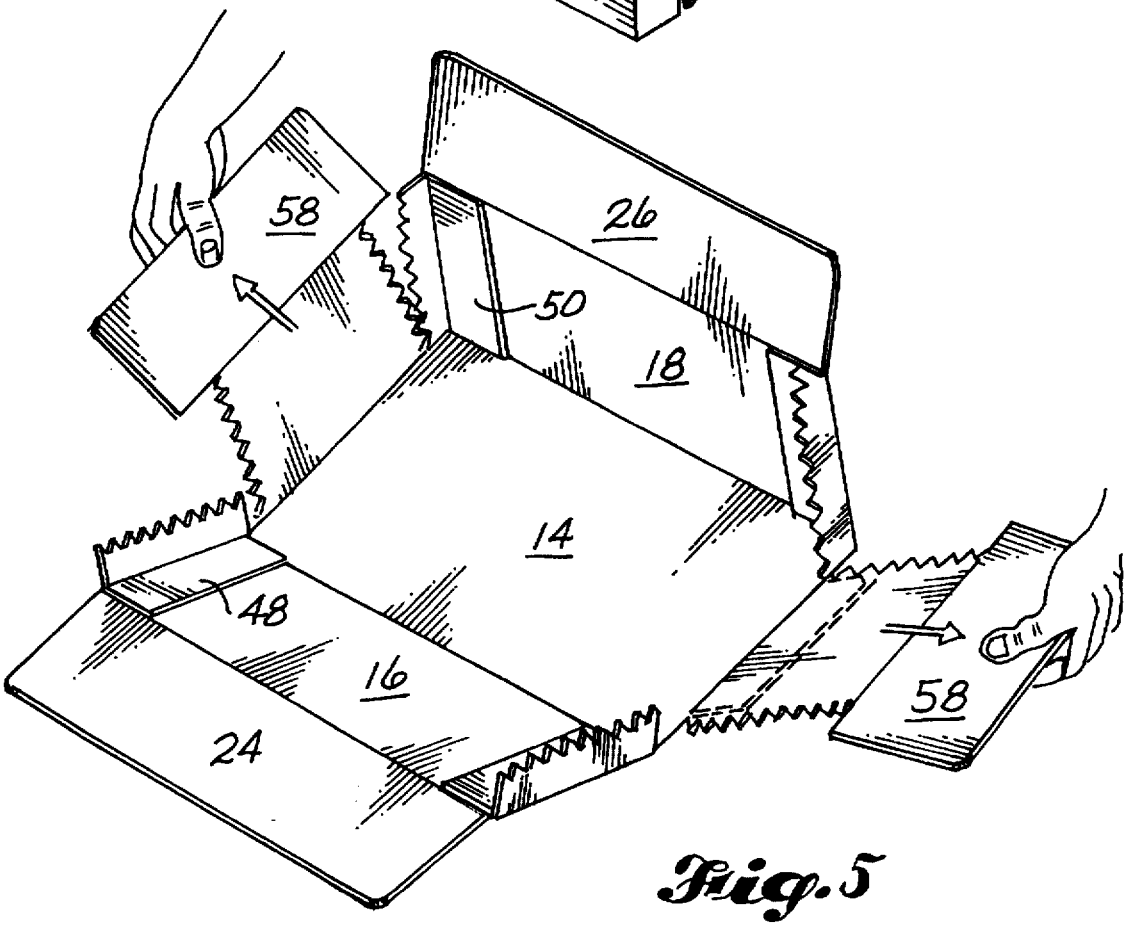
Fig. 5

FLEXOGRAPHIC PRINTER

BACKGROUND OF THE INVENTION

1. Field of the Invention

The present invention relates to a flexographic printer for use in a corrugated board box making machine etc., for example, a bottom printing type flexographic printer in which inking rolls etc. are provided under a sheet path line.

2. Description of the Prior Art

FIG. 2 is a side view showing a bottom printing type flexographic printer in the prior art and FIGS. 3(*a*), (*b*) are side views showing an initial processing part of a usual corrugated board box making machine in the prior art.

In a usual corrugated board box making machine in the prior art, as shown in FIGS. 3(*a*), (*b*), corrugated board sheets 4 stacked on a table of a paper feed unit 13 are taken out one after another toward the downstream side to be transferred to a printing unit (flexographic printer) 14, and after being applied by a desired printing there, the sheet 4 is transferred through a paper discharge unit 15, a die cutting unit 16 and a glue application unit (not shown in the figure), and is folded at a folding unit (not shown in the figure) for a box making and is further transferred to a counter-ejector unit (not shown in the figure), being a final processing part, to be stacked there.

In said printing unit 14, there is provided a top printing type flexographic printer as shown in FIG. 3(*a*), in which inking rolls (a rubber roll 1 and an anilox roll 2) and printing cylinders 3*a*, 3*b* having printing dies 6*a*, 6*b*, respectively, fitted around its outer circumferential face are provided on the upper side of the sheet path line on which the corrugated board sheet (to be printed) 4 is running, or a bottom printing type flexographic printer as shown in FIG. 3(*b*), in which inking rolls (a rubber roll 1 and an anilox roll 2) and printing cylinders 3*a*, 3*b* having printing dies 6*a*, 6*b*, respectively, fitted around its outer circumferential face are provided on the lower side of the sheet path line on which the corrugated board sheet (to be printed) 4 is running.

Numerals 7, 7 of FIGS. 3(*a*) and (*b*) designate impression rolls provided right under or right above the printing cylinders 3*a*, 3*b*, and said impression rolls have a function to give a desired pressing force onto the corrugated board sheet 4 supplied between the printing dies 6*a*, 6*b* and the impression rolls as well as a function to support pinchingly and transfer the corrugated board sheet 4.

In said top printing type flexographic printer (or bottom printing type flexographic printer), ink 5*a*, 5*b* supplied into the nip portion of the inking rolls (the rubber roll 1 and the anilox roll 2) is transferred via the anilox roll 2 onto the printing dies 6*a*, 6*b* fitted around the outer circumferential face of the printing cylinders 3*a*, 3*b* and is further transferred onto the surface of the corrugated board sheet 4 running between the printing cylinders 3*a*, 3*b* and the impression rolls 7, 7 so that a printing is made.

On the downstream side of said printing unit 14, a pull collar 17 and a pull roll 18 to transfer the corrugated board sheet 4 toward the downstream side with a desired timing are provided. Said pull roll 18 is a solid roll having a length of the lateral width-wise length of the corrugated board sheet 4, and said pull collar 17 is a plurality of ring-like ones movable in the axial direction of a shaft 19 and positionable at a desired position.

A connecting conveyor 15*a* at said paper discharge unit 15 has a function to provide a certain distance between the corrugated board sheets before the sheet comes to the next process (die cutting process), so that the printed sheet is dried.

Said die cutting unit 16 is composed of an anvil cylinder 20 and a knife cylinder 23 having a die cutting knife 22 fixed on its surface via a cutter plate 21, and while the running corrugated board sheet 4 is supported between both cylinders 20, 23 and is transferred, a die cutting to a desired shape is carried out. Said knife cylinder 23 is usually provided on the reverse side of the face to be printed, that is, in case of a top printing type flexographic printer shown in FIG. 3(*a*), on the lower side of the sheet path line, for reason of an accuracy of die cutting process of hand holes etc. and a good appearance.

In said corrugated board box making machine as shown in FIGS. 3(*a*), (*b*), there are such shortcomings as mentioned below:

That is, in case of a corrugated board box making machine in which a top printing type flexographic printer is provided at the printing unit 14 as shown in FIGS. 3(*a*), cutting scraps of hand holes etc. are difficult to be collected so that they may be put on the running corrugated board sheet 4 and transferred to the downstream side to become a cause of various troubles in the later processings.

In case of a corrugated board box making machine in which a bottom printing type flexographic printer is provided at the printing unit 14 as shown in FIG. 3(*b*), cutting scraps are usually pushed downwardly of the corrugated board sheet 4 and such a shortcoming that they are put on the corrugated board sheet 4 and transferred to the downstream side does not occur.

As another problem, however, as shown in FIG. 2, as the inking rolls (the rubber roll 1 and the anilox roll 2) are provided under the sheet path line, although an inking roll cover 8 is provided, paper dusts or cutting scraps easily come in the inking roll cover 8 through a gap between the inking roll cover 8 and the printing cylinder 3 so that they stick on the outer circumferential faces of the rubber roll 1 or the anilox roll 2, or they mix with the ink supplied into the nip portion of the rubber roll 1 and the anilox roll 2, which brings about problems that there occurs a part where no inking is made on the printing face, or too much ink 5 is put on a part of the printing face so that ununiformity of inking amount (ununiform dispersion of ink density) occurs.

Further, as the printing obstruction due to the ununiformity of such inking process tends to occur repeatedly on the corrugated board sheets being supplied one after another, there are many cases where the faultily printed papers are made continuously.

These problems tend to occur at the bottom printing type flexographic printer structurally, but at the top printing type flexographic printer also, there is a possibility of such problem to occur because of scattering paper dusts. Hence, a countermeasure to such printing obstruction caused by the ununiformity of inking process is being desired.

SUMMARY OF THE INVENTION

In view of the foregoing problems in the prior art, it is an object of the present invention to provide a flexographic printer which can dissolve the ununiformity of inking process (ununiform dispersion of ink density) so as to enable a high quality printing and can shorten a cleaning time of inking rolls so as to enhance an operation rate (productivity) of the printer.

In order to attain the above object, a flexographic printer according to the present invention in which ink supplied into a nip portion of inking rolls consisting of a rubber roll and an anilox roll is transferred via the anilox roll onto a printing die fitted around the outer circumferential face of a printing cylinder and is further transferred onto the face of a sheet running between the printing cylinder and an impression roll, thereby a printing is made, comprises an inking roll cover surrounding said inking rolls and forming a gap between itself and said printing cylinder and a static pressure forming means for supplying air into said inking roll cover while printing and forming a slightly higher static pressure within said inking roll cover than that of the peripheral area.

In said flexographic printer according to the present invention, said static pressure forming means may be composed of a pressure tank provided at said inking roll cover and connected to the inside thereof, a filter provided at an air intake of said pressure tank and a pressurized air supply means provided within said pressure tank on the inner side of said filter.

Said pressurized air supply means may be a fan, a blower or a compressor.

In the flexographic printer according to the present invention, composed as mentioned above, ink supplied into the nip portion of inking rolls consisting of the rubber roll and the anilox roll is transferred via the anilox roll onto the printing die fitted around the outer circumferential face of the printing cylinder and is further transferred onto the face of sheet running between the printing cylinder and the impression roll, thereby a printing is made. And while the printing is being made, air is blown into the inking roll cover by a static pressure forming means, for example, a static pressure forming means consisting of a pressure tank, a filter and a pressurized air supply means like a fan, a blower, a compressor etc. and a slightly higher static pressure than that of the peripheral area is formed within said inking roll cover. Thereby, the air is ejected to the outside of the inking roll cover from a gap between the inking roll cover and the printing cylinder, and by a dynamic pressure caused thereby, paper dusts, paper scraps, other scattering dusts etc. are prevented from coming in the inking roll cover, thus their sticking on the outer circumferential face of the rubber roll or the anilox roll, as well as their mixing with the ink supplied into the nip portion of the rubber roll and the anilox roll, etc. can be prevented.

BRIEF DESCRIPTION OF THE DRAWINGS

In the accompanying drawings:

FIG. 1(*a*) is a side view showing a preferred embodiment of a flexographic printer according to the present invention, and FIG. 1(*b*) is a longitudinal sectional front view taken on line A—A in the direction of arrows of FIG. 1(*a*).

FIG. 2(*a*) is an enlarged side view showing a flexographic printer (bottom printing type flexographic printer) in the prior art, and FIG. 2(*b*) is a front view of the part seen in the direction of arrow B of FIG. 2(*a*).

DESCRIPTION OF THE PREFERRED EMBODIMENTS

Figure 3A:
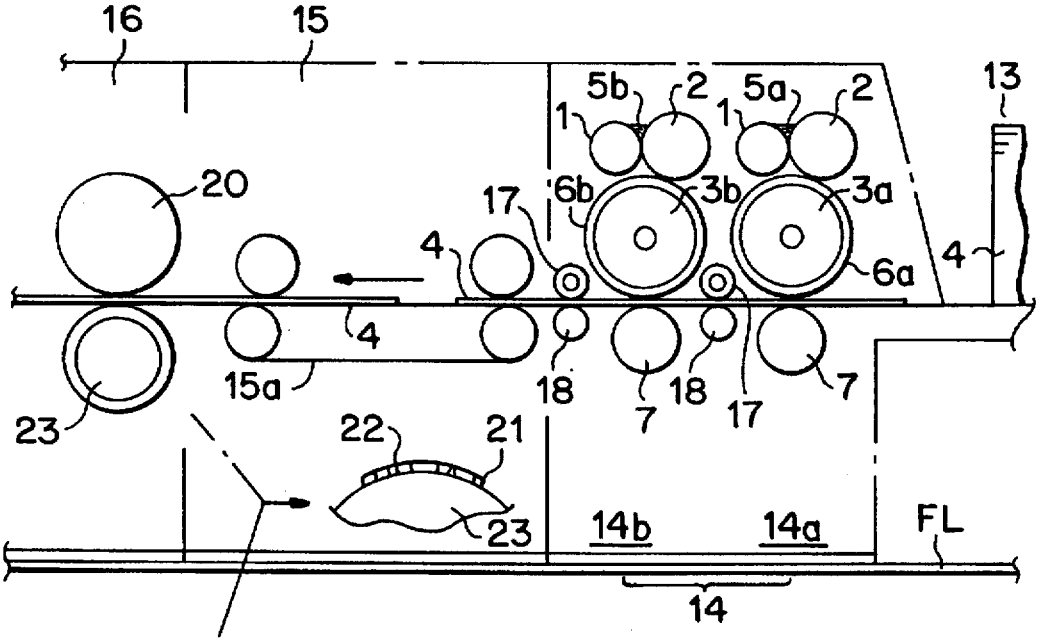
FIG. 3A PRIOR ART
FIG. 3(*a*) is a side view showing a flexographic printer (top printing type flexographic printer) applied to a printing unit of a corrugated board box making machine in the prior art, and FIG. 3(*b*) is a side view showing a flexographic printer (bottom printing type flexographic printer) applied to a printing unit of same.
Figure 3B:
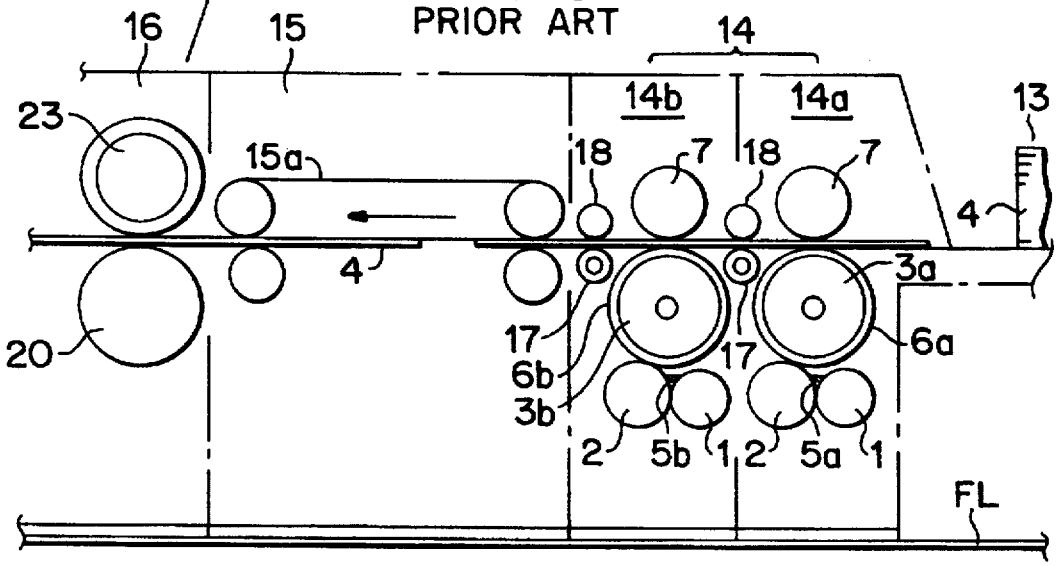
FIG. 3B PRIOR ART

A flexographic printer (bottom printing type flexographic printer) according to the present invention is described based on a preferred embodiment shown in FIGS. 1(*a*), (*b*). In FIG. 1(*a*), numeral 1 designates a rubber roll (inking roll), numeral 2 designates an anilox roll (inking roll), numeral 3 designates a printing cylinder, numeral 4 designates a corrugated board sheet, numeral 5 designates ink, numeral 6 designates a printing die fitted around the outer circumferential face of said printing cylinder 3, numeral 7 designates an impression roll provided right above said printing cylinder 3, numeral 8 designates an inking roll cover (box), numeral 9 designates a pressure tank provided at said inking roll cover 8, numeral 10 designates a filter provided at the outer end opening portion of said pressure tank 9, numeral 11 designates a fan provided within said pressure tank 9 on the inner side of said filter 10, and numeral 12 designates an air vent opening from the inside of said pressure tank 9 on the inner side of said fan 11 toward the inside of said inking roll cover 8.

In FIGS. 1(*a*), (*b*), numeral 17 designates a pull collar disposed on the downstream side of said printing cylinder 3 and said impression roll 7, numeral 19 designates a shaft of said pull collar 17, and numeral 18 designates a pull roll disposed right above said pull collar 17.

Next, functions of the flexographic printer (bottom printing type flexographic printer) shown in FIGS. 1(*a*), (*b*) are described concretely.

The ink 5 supplied into the nip portion of a pair of inking rolls consisting of the rubber roll 1 and the anilox roll 2 is transferred onto the printing die 6 fitted around the outer circumferential face of the printing cylinder 3 and is further transferred onto the surface of the corrugated board sheet 4 coming in between the printing cylinder 3 and the impression roll 7 and a desired printing is made.

At this time, a clean air is taken through the filter 10 of the pressure tank 9 and, passing through the fan 11 and the air vent 12, it is blown into the inking roll cover 8, so that a slightly higher static pressure $P_1$ than a pressure $P_2$ of the peripheral area is formed within the inking roll cover 8. Thus, the air is ejected to the outside of the inking roll cover 8 from a gap between the inking roll cover 8 and the printing cylinder 3, and by a dynamic pressure caused thereby, paper dusts, paper scraps or other scattering dusts etc. are prevented from coming in the inking roll cover 8, thereby their sticking on the outer circumferential face of the rubber roll 1 or the anilox roll 2, or their mixing with the ink 5 supplied into the nip portion of the rubber roll 1 and the anilox roll 2 can be prevented.

Incidentally, the air vent 12 provided at the lower end portion of the pressure tank 9 may functionally be a slit provided along the axial direction of the printing cylinder 3. And as the air pressurizing means, a blower or a compressor etc. can be used in place of the fan 11. Further, a flexographic printer according to the present invention is also applicable to a top printing type flexographic printer.

In the flexographic printer according to the present invention, ink supplied into the nip portion of inking rolls consisting of the rubber roll and the anilox roll is transferred via the anilox roll onto the printing die fitted around the outer circumferential face of the printing cylinder and is further transferred onto a face of sheet running between the printing cylinder and the impression roll, thereby a printing is made. And while the printing is being made, as air is blown into the inking roll cover by a static pressure forming means, for example, a static pressure forming means consisting of a pressure tank, a filter and a pressurized air supply means like a fan, a blower, a compressor etc. and a slightly higher static pressure than that of the peripheral area is formed within said inking roll cover. Thereby, the air is ejected to the outside of the inking roll cover from a gap between the inking roll cover and the printing cylinder, and by a dynamic pressure caused thereby, paper dusts, paper scraps, other scattering dusts etc. are prevented from coming in the inking roll cover, thus their sticking on the outer circumferential face of the rubber roll or the anilox roll, as well as their mixing with the ink supplied into the nip portion of the rubber roll and the anilox roll, etc. can be prevented, hence an ununiformity of inking process on the printing part etc. is dissolved and a high quality printing can be made.

Further, as mentioned above, paper dusts, paper scraps, other scattering dusts etc. are prevented from coming in the inking roll cover and their sticking on the outer circumferential face of the rubber roll and the anilox roll as well as their mixing with the ink supplied into the nip portion of the rubber roll and the anilox roll, hence a cleaning time of the inking rolls etc. can be shortened and the operation rate (productivity) of the printer can be enhanced.

While the preferred form of the present invention has been described, variations thereto will occur to those skilled in the art within the scope of the present inventive concepts which are delineated by the following claims.

What is claimed is:

1. A flexographic printer in which ink supplied into a nip portion of inking rolls including a rubber roll and an anilox roll is transferred via the anilox roll onto a printing die fitted around the outer circumferential face of a printing cylinder and is further transferred onto the surface of a sheet running between the printing cylinder and an impression roll, thereby a printing is made, comprising an inking roll cover surrounding said inking rolls and forming a gap between itself and said printing cylinder and a static pressure forming means for supplying air into said inking roll cover while printing and forming a slightly higher static pressure within said inking roll cover than that of the peripheral area such that air is ejected through said gap and dust and scraps are prevented from entering the inking roll cover through said gap, wherein said static pressure forming means includes a pressure tank provided at said inking roll cover and connected to the inside of said inking roll cover, a filter provided at an air intake of said inking roll cover, a filter provided at an air intake of said pressure tank and a pressurized air supply means provided within said pressure tank on the inner side of said filter, wherein said pressurized air supply means is a fan, a blower or a compressor, and wherein said pressure tank has an interior space that is connected to the interior of said inking roll cover through an air vent, the air vent being a slit which extends generally parallel to an axial direction of the printing cylinder.

2. A flexographic printer as claimed in claim 1, wherein said printer is a bottom printing type flexographic filter.

3. A flexographic printer as claimed in claim 1, wherein said pressurized air supply means is a fan.

4. A flexographic printer as claimed in claim 1, wherein said slit is provided at a lower end of the pressure tank.

5. A corrugated board box making machine, comprising:

a flexographic printer in which ink supplied into a nip portion of inking rolls including a rubber roll and an anilox roll is transferred via the anilox roll onto a printing die fitted around the outer circumferential face of a printing cylinder and is further transferred onto the surface of a sheet running between the printing cylinder and an impression roll, thereby a printing is made, comprising an inking roll cover surrounding said inking rolls and forming a gap between itself and said printing cylinder and a static pressure forming means for supplying air into said inking roll cover while printing and forming a slightly higher static pressure within said inking roll cover than that of the peripheral area such that air is ejected through said gap and dust and scraps are prevented from entering the inking roll cover through said gap, a discharge unit which discharges corrugated board sheets from the flexographic printer, a cutting unit which cuts the corrugated board sheets discharged from the discharge unit, wherein said static pressure forming means includes a pressure tank provided at said inking roll cover and connected to the inside of said inking roll cover, a filter provided at an air intake of said pressure rank and a pressurized air supply means provided within said pressure rank on the inner side of said filter, and wherein said pressure tank has an interior space that is connected to the interior of said inking roll cover through an air vent, the air vent being a slit which extends generally parallel to an axial direction of the printing cylinder.

6. A corrugated board box making machine as claimed in claim 5, wherein said pressurized air supply means is a fan, a blower or a compressor.

7. A corrugated board box making machine as claimed in claim 5, wherein said printer is a bottom printing type flexographic filter.

8. A corrugated board box making machine as claimed in claim 5, wherein said pressurized air supply means is a fan.

9. A corrugated board box making machine as claimed in claim 5, wherein said slit is provided at a lower end of the pressure tank.

* * * * *